United States Patent [19]

Nakamura et al.

[11] Patent Number: 4,633,364

[45] Date of Patent: Dec. 30, 1986

[54] STATIC SHOCK ELIMINATOR

[75] Inventors: Mitsuo Nakamura; Sumihiro Kaga, both of Kariya; Toshitaka Tanahashi, Okazaki, all of Japan

[73] Assignee: Nippondenso Co., Ltd., Kariya, Japan

[21] Appl. No.: 770,093

[22] Filed: Aug. 28, 1985

[30] Foreign Application Priority Data

Aug. 28, 1984 [JP] Japan ..... 59-180184
Oct. 3, 1984 [JP] Japan ..... 59-207730

[51] Int. Cl.[4] ..... H05F 3/00
[52] U.S. Cl. ..... 361/216; 361/220
[58] Field of Search ..... 361/212, 216, 220, 222

[56] References Cited

U.S. PATENT DOCUMENTS 3,099,774 1/1960 Crane ..... 361/220

*Primary Examiner*—L. T. Hix
*Assistant Examiner*—Douglas S. Lee
*Attorney, Agent, or Firm*—Cushman, Darby & Cushman

[57] ABSTRACT

A static shock eliminator adapted for use in attachment to a conductive grounding object such as a metallic door knob, handle or key cylinder, which comprises a high resistance plate arranged adjacent the conductive grounding object and engaged at a portion thereof with the same. The high resistance plate has a first surface to be brought into contact with a person at a portion spaced from the conductive grounding object in a predetermined distance and a second surface to be adhered to a surface of a member on which the conductive grounding object is mounted.

5 Claims, 13 Drawing Figures

STATIC SHOCK ELIMINATOR

BACKGROUND OF THE INVENTION

The present invention relates to static shock eliminators, and more particularly to a static shock eliminator adapted for use in attachement to a conductive grounding object such as a metallic door knob, handle, key cylinder or the like.

Such conventional static shock eliminators as described above are arranged to eliminate static shock caused when, after accumulated static electricity, a person contacted the conductive grounding object. In U.S. Pat. No. 3,099,774 issued on July 30, 1963, there has been proposed one of the conventional static shock eliminators which is adapted for utilization in an automobile for discharging the static electricity accumulated in a person due to friction with the automobile seats.

The static shock eliminator comprises a first flat insulator adhered to a conductive grounding body of an automobile, and a second flat insulator adhered to the first flat insulator by way of a high resistance element and a pad. The second flat insulator is provided with a central aperture through which the resistance element is depressed by a person. The pad and first flat insulator are also respectively provided with central apertures which are alinged with the central aperture of the first insulator. When depressed by the person, the resistance element is resiliently flexed and brought into contact with the metallic surface of the conductive grounding body to dissipate the accumulated static electricity so as to eliminate static shock on the person.

In such a conventional static shock eliminator described above, the pad must be interposed between the resistance element and the first flat insulator to permit resilient contact of the resistance element with the conductive grounding body. This results in a complicated construction of the static shock eliminator. The resistance element must be further arranged to be in contact with the metallic surface of the conductive grounding body. For this reason, the shock eliminator cannot be attached to an object coated with an insulation layer. Furthermore, if a depression force acting on the resistance element is unbalanced, the static shock may not be eliminated due to insufficient contact of the resistance element with the conductive grounding body. It is further apparent that the life of the resistance element is shortened by frequent depressions of the resistance element.

SUMMARY OF THE INVENTION

It is a primary object of the present invention to provide an improved static shock eliminator which can be attached in a simple construction to a conductive grounding object without any limitation of its attachment place.

It is another object of the present invention to provide an improved static shock eliminator, having the above-mentioned characteristics, which is effective for a long period of time to dissipate static electricity accumulated in a person when brought only into contact with him.

It is still another object of the present invention to provide an improved static shock eliminator, having the above-mentioned characteristics, wherein a resilient contact element is provided in a simple manner to ensure electric contact with a conductive grounding object.

According to the present invention, there is provided a static shock eliminator adapted for use in attachment to a conductive grounding object such as a metallic door knob, handle or key cylinder, which comprises a high resistance plate arranged adjacent the conductive grounding object and engaged at a portion thereof with the same, the high resistance plate having a first surface to be brought into contact with a person at a portion spaced from the conductive grounding object in a predetermined distance and a second surface to be adhered to a surface of a member on which the conductive grounding object is mounted.

It is preferrable that the static shock eliminator further comprises a metallic spring element contained within the second surface of the high resistance plate to be engaged at one end thereof with the conductive grounding object.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
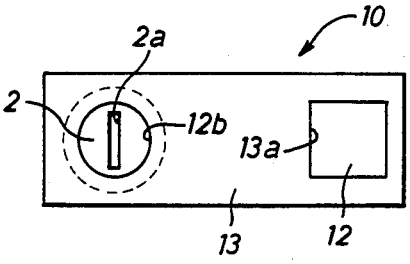
FIG. 1 is a plan view of an embodiment of a static shock eliminator in accordance with the present invention adapted to a key cylinder of an automobile door.
Figure 2:
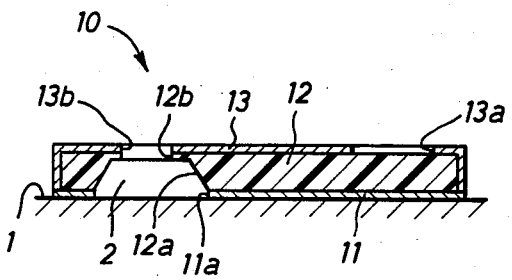
FIG. 2 represents a cross-section of the static shock eliminator adhered to a surface of the automobile door adjacent the key cylinder.

Referring now to FIGS. 1 and 2 of the drawings, there is illustrated a static shock eliminator 10 in accordance with the present invention which is adapted to a door 1 of an automobile. The static shock eliminator 10 comprises a double-coated adhesive tape 11 which has insulation properties and is adhered at one adhesive surface thereof to a surface of door 1 adjacent a conductive key cylinder 2 provided on door 1 and grounded to the automobile body. The adhesive tape 11 is provided at its one end portion with an aperture 11*a* in which the key cylinder 2 is inserted at its head portion. The static shock eliminator 10 also comprises a rectangular touch plate 12 which is made of conductive material with a high resistance value of $10^7$ to $10^{10}$ (MΩ) and adhered at one surface thereof to the other adhesive surface of adhesive tape 11. The touch plate 12 has a recessed wall 12*a* at its one end portion to closely cover an outer surface of the head portion of key cylinder 2 in such a manner to ensure electrical contact with key cylinder 2. The recessed wall 12*a* is provided at its upper portion with an opening 12*b* through which the head portion of key cylinder 2 is exposed at its keyhole 2*a* outwardly. The touch plate 12 is covered by an insulation layer 13 which is made of insulation material such as insulation paints and the like. The insulation layer 13 is provided at its one end portion with an opening 13*b* which is aligned with the opening 12*b* of touch plate 12 to expose the keyhole 2*a* of key cylinder 2 therethrough outwardly. The insulation layer 13 is also provided at its other end portion with an opening 13*a* through which the other surface of the touch plate 12 is partly exposed outwardly to be touched by a person's finger. In this case, the opening 13*a* is spaced from the key cylinder 2 by a predetermined distance for defining a resistance value formed between the opening 13*a* and key cylinder 2 in a proper value necessary for dissipating accumulated static electricity from the person's body without any static shock.

When a person touches the touch plate 12 with his finger through the opening 13*a* of insulation layer 13 after accumulating static electricity in his body, the static electricity is effectively discharged through the person's finger, touch plate 12 and key cylinder 2 to the automobile body. This means that the discharge of the static electricity is done by only touch of the person's finger with touch plate 12 owing to the high resistance value of touch plate 12 to effectively eliminate static shock on the person. After this discharge of the static electricity, the person can insert an ignition key of the automobile into the keyhole 2*a* of key cylinder 2 without any static shock on his body. In this case, a surface portion of door 1 covered by static shock eliminator 10 adjacent the head portion of key cylinder 2 may be prevented from its erroneous contact with the ignition key to ensure no damage thereof.

Figure 3:
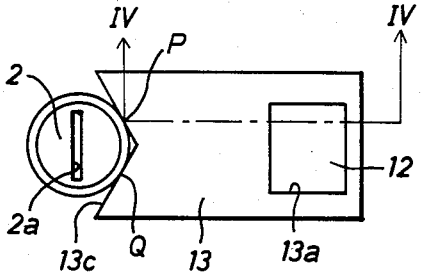
FIG. 3 is a plan view of a modification of the static shock eliminator.
Figure 4:
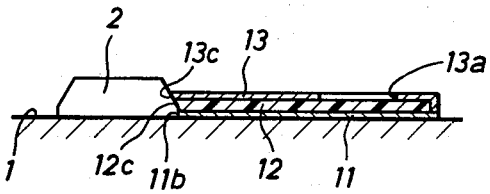
FIG. 4 represents a cross-section of the modification of the static shock eliminator taking along line IV—IV of FIG. 3.

FIGS. 3 and 4 illustrate a modification of the static shock eliminator 10 in which the adhesive tape 11, touch plate 12 and insulation layer 13 are respectively provided at their one ends with V-shaped side walls 11*b* 12*c* and 13*c* in replacement of the aperture 11*a*, recessed wall 12*a* and opening 12*b*. Thus, the V-shaped side walls 11*b*, 12*c* and 13*c* can be identically engaged at symmetrical points P and Q (see FIG. 3) with an outer periphery of the head portion of key cylinder 2, regardless of change of an outer diameter of the head portion, to ensure electical contact of touch plate 12 with key cylinder 2.

Figure 5:
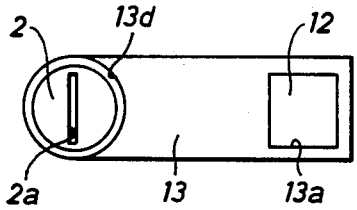
FIG. 5 is a plan view of another modification of the static shock eliminator.
Figure 6:
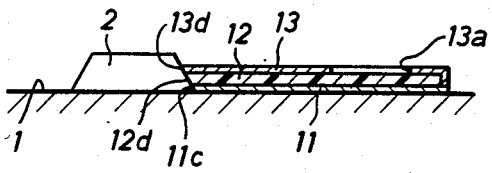
FIG. 6 illustrates a cross-section of another modification of the eliminator related to the key cylinder.

FIGS. 5 and 6 show another modification of static shock eliminator 10 in which the adhesive tape 11, touch plate 12 and insulation layer 13 are respectively provided at their ends with semi-circular side walls 11*c*, 12*d* and 13*d* in replacement of the aperture 11*a*, recessed wall 12*a* and opening 13*b*. Thus, the semi-circular side walls 11*c*, 12*d* and 13*d* can be identically engaged with the outer periphery of the head portion of key cylinder 2 to ensure electrical contact of touch plate 12 with key cylinder 2 in a nallower width of eliminator 10.

Figure 7:
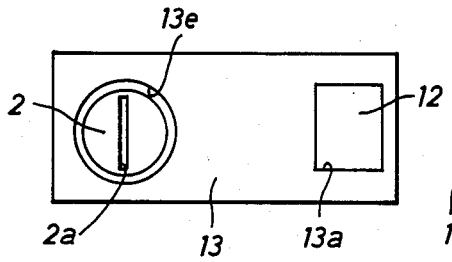
FIG. 7 is a plan view of still another modification of the static shock eliminator.
Figure 8:
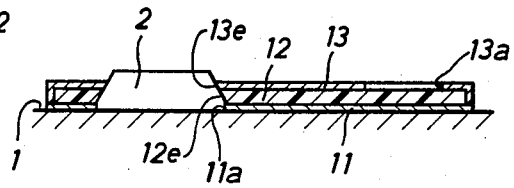
FIG. 8 represents a cross-section of still another modification of the eliminator related to the key cylinder.

FIGS. 7 and 8 depict still another modification of the static shock eliminator 10 in which the touch plate 12 and insulation layer 13 are provided at their end portions with apertures 12*e* and 13*e* in replacement of the recessed wall 12*a* and opening 12*b* respectively. Thus, the insulation layer 13 permits projection of the head portion of key cylinder 2 from the aperture 13*e* to electrically contact an inner periphery of the aperture 12*e* of touch plate 12 with the outer periphery of the head portion of key cylinder 2.

Figure 9:
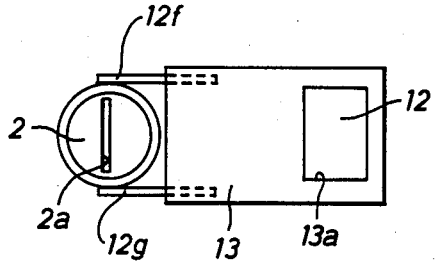
FIG. 9 is a plan view of a further modification of the static shock eliminator.
Figure 10:
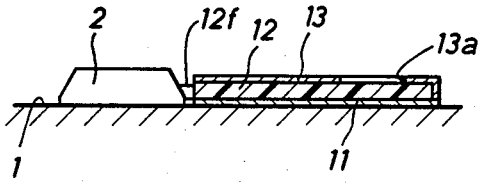
FIG. 10 illustrates a cross-section of the further modification of the eliminator engaged with the key cylinder.

FIGS. 9 and 10 illustrate a further modification of the static shock eliminator 10 in which the touch plate 12 is provided with a pair of spaced metal pins 12*f*, 12*g* respectively with low resistance values which extend from one end of touch plate 12 to eliminate the aperture 11*a* of adhesive tape 11, the recessed wall 12*a* of touch plate 12 and the opening 12*b* of insulation layer 13. Thus, both the metal pins 12*f* and 12*g* can resiliently hold therebetween the head portion of key cylinder 2, regardless of change of the outer diameter of the head portion, to effectively ensure electrical connection of touch plate 12 with key cylinder 2.

Figure 11:
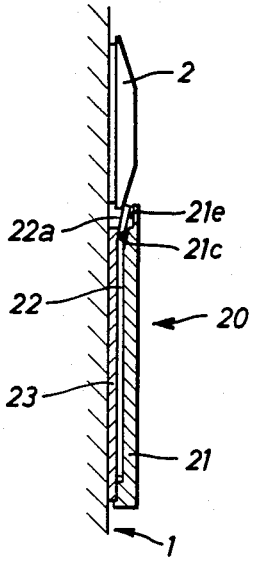
FIG. 11 illustrates a cross-section of another embodiment of the static shock eliminator taking along line XI—XI of FIG. 12 and adhered to the surface of the automobile door to engage with the key cylinder.
Figure 12:
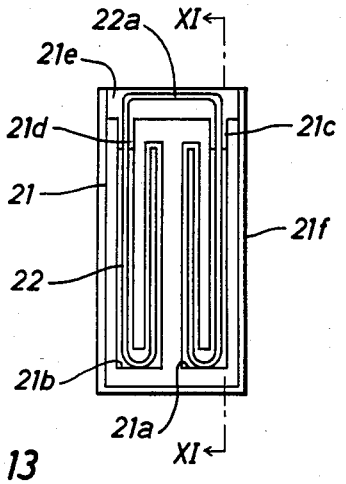
FIG. 12 is a back view of a touch plate of the eliminator shown in FIG. 12.

In FIGS. 11 and 12, there is illustrated another embodiment of the present invention in which a static shock eliminator 20 comprises a rectangular touch plate 21, a metal wire electrode 22 and a double-coated adhesive tape 23 with insulation properties. The adhesive tape 23 is adhered at one adhesive surface thereof to the surface of door 1 adjacent the head portion of the key cylinder 2. The touch plate 21 is adhered at its inner surface to the other adhesive surface, of adhesive tape 23 by way of metal wire electrode 22. In this case, the touch plate 21 is made of conductive material, having a high resistance value of about 10 to 100(MΩ), which is composed of uniform compound of such synthetic resin as rubber, vinylchloride and the like with powders of such electric resistance material as carbon and the like. The inner surface of touch plate 21 is provided thereon with a pair of U-shaped slots 21*a*, 21*b* which are arranged symmetrically with respect to a longitudinal axis of touch plate 21, as shown in FIG. 12. In FIG. 12, the reference character 21*f* indicates a U-shaped frame formed on an outer periphery of the inner surface of touch plate 21.

The metal wire electrode 22 is disposed within and along both the slots 21*a*, 21*b* in a curved configuration shown in FIG. 12 to extend a central portion 22*a* thereof from outer end portions 21*c*, 21*d* of slots 21*a*, 21*b* toward the head portion of key cylinder 2 within a recess 21*e*. The recess 21*e* is formed on one end portion of the inner surface of touch plate 21 to cover the central portion 22*a* of metal wire electrode 22. In this case, the metal wire electrode 22 is made of, for instance, a stainless steel wire having a predetermined spring constant and a diameter which is a little smaller than a width of each of slots 21*a*, 21*b*. The central portion 22*a* of metal wire electrode 22 is pressedly engaged on the head portion of key cylinder 2 by the adhesive strength of tape 23 against its resilient force and is flexed into the recess 21*e* to effectively ensure electrical contact of touch plate 21 with the key cylinder 2. In this case, the resilient force of metal wire electrode 22 is smaller than the adhesive strength of adhesive tape 23. In addition, a depth of recess 21*e* is arranged to be deeper than that of each of slots 21*a*, 21*b* to slant a bottom of each of the outer end portions 21*c*, 21*d* toward a bottom of recess 21*e* in such a manner to smoothly flex the central portion 22*a* of metal wire electrode 22 into the recess 21*e*.

For adhesion of the static shock eliminator 20 to the automobile door 1, the static shock eliminator 20 has only to be adhered by the adhesive tape 23 to the surface of door 1 such that the central portion 22*a* of metal wire electrode 22 is pressedly engaged on the head portion of key cylinder 2 and flexed into the recess 21*e* of touch plate 21 along the slanted bottoms of slots 21*a*, 21*b*. In this case, the static shock eliminator of this kind may be provided in a simple construction, because it is formed only by the touch plate 21, metal wire electrode 22 and adhesive tape 23.

After adhesion of the static shock eliminator 20, uniform adhesion of adhesive tape 23 to the surface of door 1 and the inner surface of touch plate 21 may be firmly maintained because the adhesive strength of tape 23 is larger than the resilient force of metal wire electrode 22. In this case, the static shock eliminator 20 may be maintained in place without causing any damage of the central portion 22*a* of metal wire electrode 20 and any spoil of the beauty on the door 1, because the metal wire electrode 22 is wholly covered by the touch plate 21. Additionally, the metal wire electrode 22 may be easily flexible in dependence upon configurations of various key cylinders of automobile doors and effectively utilized as a grounding electrode, because it is made of wire material. This means that resilient engagement of the central portion 22*a* of metal wire electrode 22 with the head portion of key cylinder 2 may firmly maintain electrical contact of the touch plate 21 with the key cylinder 2.

It is assumed that static electricity is accumulated in positive condition in the person's body prior to opening of the door 1. When the person contacts an outer surface of touch plate 21 with his finger, the quantity of positive charges based on the static electricity transiently flows from the person's finger into the automobile body through the touch plate 21, metal wire electrode 22 and key cylinder 2. In this case, the rate of transient flow quantity of the positive charges from the person's body to the automobile body may be limitted in a small value owing to the high resistance value of touch plate 21 to maintain in a small value the gradient of a potential difference between the person's finger and the eliminator 20. This means that the static electricity accumulated in the person's body may be effectively discharged through the eliminator 20 without causing any static shock to the person. After this discharge of the static electricity, the person does not feel any static shock even if he inserts the ignition key into the keyhole 2*a* of key cylinder 2.

Furthermore, it is assumed that static electricity is accumulated in negative condition in the person's body prior to opening of the door 1. When the person contacts the outer surface of touch plate 21 with his finger, the quantity of positive charges transiently flows from the automobile body into the person's body through the key cylinder 2, metal wire electrode 22, touch plate 21 and the person's finger to neutralize negative charges based on the accumulated static electricity. In this case, the rate of the transient flow quantity of the positive charges from the automobile body to the person's body may be limitted in a small value owing to the high resistance value of touch plate 21 to maintain in a small value the gradient of an electric potential difference between the person's finger and the shock eliminator 20. This means that the negative electricity accumulated in the person's body may be effectively neutralized by the shock eliminator 20 without causing any static shock to the person. After this neutralization of the negative electricity, the person does not feel any static shock even if he inserts the ignition key into the keyhole 2*a* of key cylinder 2.

Figure 13:
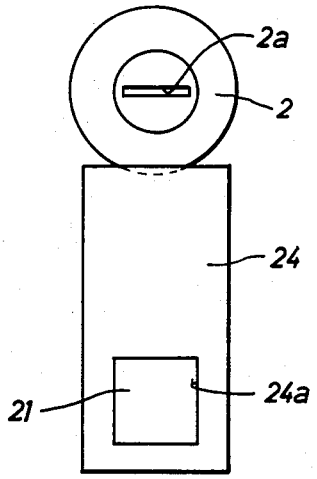
FIG. 13 is a plan view of a modification of the static shock eliminator shown in FIG. 11.

FIG. 13 illustrates a modification of the static shock eliminator 20 in which an insulation layer 24 covers the outer surface of touch plate 21 and is provided thereon with an opening 24*a* to partly expose the outer surface of touch plate 21 outwardly. In this case, the openign 24*a* is spaced from the head portion of key cylinder 2 in the same distance as that of the previous embodiment. This leads to uniformalization in the rate of discharge or neutralization of the accumulated static electricity without any static shock.

For repair of the static shock eliminator 10 (or 20), the static shock eliminator can be removed in a simple manner by only removal of the adhesive tape 11 ( or 23) without causing any damage of the surface of door 1. This is useful to facilitate maintenance of the shock eliminator 10 (or 20).

In the actual practices of the present invention, the static shock eliminator 10 (or 20) may be also adapted to such various grounding metal fittings such as window handles or cover knobs of automobiles, door handles or knobs of buildings and the like. In this case, the outer surface of layer 13 (or the touch plate 21) may be coloured to enhauce the beauty thereof.

Although in another embodiment described above the metal wire electrode 22 is wholly covered by the touch plate 21, it may be also arranged to extend at its central portion 22*a* from the touch plate 21 outwardly in order to engage with the head portion of key cylinder 2. In this case, the outer surface of touch plate 21 may be arranged to be covered by a metal plate. This metal plate may avoid direct contact of the person's finger with the touch plate 21 to prevent defacement of the outer surface of touch plate 21. Furthermore, the metal wire electrode 22 may be modified in its configuration in necessity or replaced with a metal plate electrode to eliminate the slots 21*a*, 21*b* of touch plate 21.

For the actual practices of the present invention, the double-coated adhesive tape 11 (or 23) described above may be replaced with an adhesive layer which is coated on the inner surface of touch plate 12 (or 21) and releasably provided at its adhesive surface with a release paper. In the modification, after release of the release paper from touch plate 12 (or 21) prior to attachment of the shock eliminator 10 ( or 20), the shock eliminator 10 (or 20) is adhered by the insulation layer to the surface of door 1 in the same manner as that of each of the previous embodiments.

Having now fully set forth both structure and operation of preferred embodiments of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A static shock eliminator adapted for use in attachment to a conductive grounding object such as a metallic door knob, handle or key cylinder, comprising a high resistance plate formed in a rectangular shape to be engaged at one end portion thereof with said conductive grounding object, said high resistance plate having a first surface to be brought into contact with a person and a second surface to be adhered to a surface of a member on which said conductive grounding object is mounted, and an insulation layer integrally formed on said first surface of said high resistance plate in such a manner that said first surface is exposed only at a portion spaced from said conductive grounding object at a predetermined distance.

2. A static shock eliminator as claimed in claim 1, further comprising a metallic spring element contained within the second surface of said high resistance plate to be engaged at one end thereof with said conductive grounding object.

3. A static shock eliminator as claimed in claim 2, further comprising a tape adhered at one surface thereof to the second surface of said high resistance plate to retain said spring element in place and coated at another surface thereof with adhesive to be attached to the surface of the member on which said conductive grounding object is mounted.

4. A static shock eliminator as claimed in claim 1, wherein said high resistance plate is formed at one end portion thereof with a recess for engagement with the head portion of a key cylinder mounted in an automobile door.

5. A static shock eliminator as claimed in claim 1, further comprising a tape having a first surface adhered to the second surface of said high resistance plate and a second surface coated with adhesive to be attached to the surface of the member on which said conductive grounding object is mounted.

* * * * *